United States Patent [19]

Corbett, Jr.

[11] 4,287,940

[45] Sep. 8, 1981

[54] COOLING APPARATUS FOR DIFFUSERS

[76] Inventor: Robert L. Corbett, Jr., 22732 Lake Rd., Rocky River, Ohio 44116

[21] Appl. No.: 50,168

[22] Filed: Jun. 20, 1979

[51] Int. Cl.[3] ..... C21D 9/673; F27D 9/00

[52] U.S. Cl. ..... 165/48 R; 165/61; 165/122; 266/256; 432/83; 432/260

[58] Field of Search ..... 432/260, 83; 165/122, 165/47, 53, 54, 56, 48 R, 61; 260/256, 262, 263, 264

[56] References Cited

U.S. PATENT DOCUMENTS

| | | | |
|---|---|---|---|
| 3,140,743 | 7/1964 | Cone | 165/61 |
| 3,361,420 | 1/1968 | Morgan | 165/61 X |
| 3,580,331 | 5/1971 | Wargo | 432/83 X |
| 3,586,302 | 6/1971 | Corbett, Jr. | 432/260 |
| 3,618,921 | 11/1971 | Corbett, Jr. | 432/260 |
| 3,716,223 | 2/1973 | Corbett, Jr. | 432/260 |
| 3,802,834 | 4/1974 | Corbett, Jr. | 432/260 |
| 3,850,417 | 11/1974 | Elorza | 266/256 X |

*Primary Examiner*—Sheldon J. Richter
*Attorney, Agent, or Firm*—J. Helen Slough

[57] ABSTRACT

A diffuser adapted for transmitting thermal energy by conduction across metallic members and by convection of a heat-treating gas in an annealing furnace is comprised of a base, a diffuser member having a plurality of radial gas passages, and an in-line cooling member disposed longitudinally within each of the radial passages; which cooling member includes a cooling fluid inlet, at least one radial cooling fluid leg having a longitudinal axis extending substantially in the direction of the gas flow through the radial passage, and a cooling fluid outlet.

19 Claims, 10 Drawing Figures

COOLING APPARATUS FOR DIFFUSERS

The present invention relates generally to diffusers adapted for transmitting thermal energy by conduction across metallic members and by convection of a heat-treating gas in an annealing furnace. More specifically, the present invention relates to an in-line cooling assembly for improved efficiency in the cooling cycle of an annealing process.

Annealing furnaces of various types are, of course, well-known in the art. Each has the general purpose of heat treating steel products in order to impart desired metallurgical properties thereto. This is achieved by heating the metallic charge within the furnace to a given temperature for an appropriate length of time, and then cooling the charge. There are many variables which must be taken into account in such a heat-treating process. Uniformly, however, it is highly desirable to balance the variables in order to perform the annealing cycle as quickly as possible to thereby increase production output.

In annealing furnaces adapted for treating coils of strip metal or the like, considerable effort has been expended to improve the efficiency of the heating portion of the cycle in order to improve both the uniformity of treatment of the coiled strip charge, as well as production output. These furnaces typically are used to anneal a stack of coils placed within an inner furnace housing through which an appropriate heat-treating gas is circulated. The lowermost coil in the stack is usually supported on a diffuser plate; and each individual coil within the stack is separated from an adjacent coil by a convector plate. Radiant energy is applied to the housing and the gas is caused to circulate in an appropriate path therein. Conventionally, a fan is disposed at the base of the annealing furnace for circulation of the gas outwardly and upwardly from the diffuser, inwardly through the convector plates between adjacent coils, and downwardly through the central eye or opening in the stack of coils. Heat is transferred to the coiled charge by convection of the gas and conduction of heat across the metal components comprising both the diffuser and the convector plates.

Many devices and structures have been used in the past for increasing the efficiency and/or output rate of such annealing furnaces. For example, particular furnace structures have been used which permit the removal of the heating components once the heating cycle has been completed in a first furnace, so that the heater may be employed on a second furnace while the charge in the first is cooling. See U.S. Pat. No. 3,071,500. Improvements in the efficiency of the fan member which circulates the gas have also been made. See U.S. Pat. No. 3,669,563. Specific structural improvements in the diffuser plates and convector plates employed to direct the gas flow have likewise been made. See U.S. Pat. Nos. 3,586,302, 3,618,921, 3,716,223, and 3,802,834.

Each of the aforementioned improvements in structural elements within annealing furnaces has been quite successful. That is, efficiency during the heating cycle has been greatly improved by these contributions. To date, very little has been done to enhance the efficiency of the cooling portion of the annealing cycle. One approach has been the incorporation of a series of circumferential cooling tubes within the diffuser of such a furnace. This has not been very effective for a number of reasons. First, the cooling coils themselves pass through the radial gas flow passages in a direction substantially transverse to gas flow. This obstructs free passage of the gas and causes turbulence downstream of the cooling coil. These are substantial disadvantages. Also, only the upstream surface of the cooling coil effectively contacts the moving gas, and cooling is not particularly efficient.

A second major disadvantage of this proposed structure is that the inlet and outlet legs for the cooling coils pass directly through the metal base plate of the diffuser member. The base plate is subjected to radical temperature variations causing expansion and contraction throughout the cycle. There is also long-term shrinkage encountered because of this cycling. Since the tubes providing for circulation of the cooling fluid pass through apertures in this plate, and must do so with close tolerance, substantial transverse constriction of the tube is encountered at this juncture. This area is, accordingly, prone to leakage of cooling fluid within the furnace. Leakage, particularly if water is employed as the cooling fluid, can damage the material being annealed by oxidation.

A second approach which has been proposed is the placement of helical cooling coils adjacent the outer periphery of the diffuse plate. The longitudinal axis of the cooling coil helix is substantially perpendicular to the flow of gas within the passage of the diffuser, and the inlet/outlet legs pass directly through the metal base plate. This approach suffers the same basic disadvantage, as outlined above.

The present invention provides a novel approach to the cooling of the circulating heat-treating gas within an annealing furnace. This is achieved, in part, by incorporating within a diffuser an in-line cooling structure disposed within each of the radial passages in the diffuser member. The cooling assembly includes at least one radial cooling fluid leg having a longitudinal axis extending substantially in the direction of gas flow through the radial passage in the diffuser. This maximizes the surface area across which the gas flows while simultaneously minimizing turbulence of the gas being circulated within the furnace. Connections for inlet and outlet legs of the cooling structure are made beyond the base of the diffuser in order to guard against constriction of the tubes as aforementioned. In a particularly preferred structure, the cooling structure in each radial passage is comprised of two radial legs, each in the general shape of a "U", extending horizontally in a vertical plane, to yield a single subassembly within each gas flow passage.

By virtue of this novel arrangement of elements, the efficiency of the cooling cycle is greatly improved without suffering the major disadvantages of other proposed cooling coil structures. This will provide a substantial advantage in production output from an annealing furnace without sacrificing quality of heat treatment.

Yet other advantages of the present invention will become apparent to those skilled in the art upon examination of the following detailed description of preferred embodiments, taken in conjunction with the figures of drawing, wherein.

Figure 1:
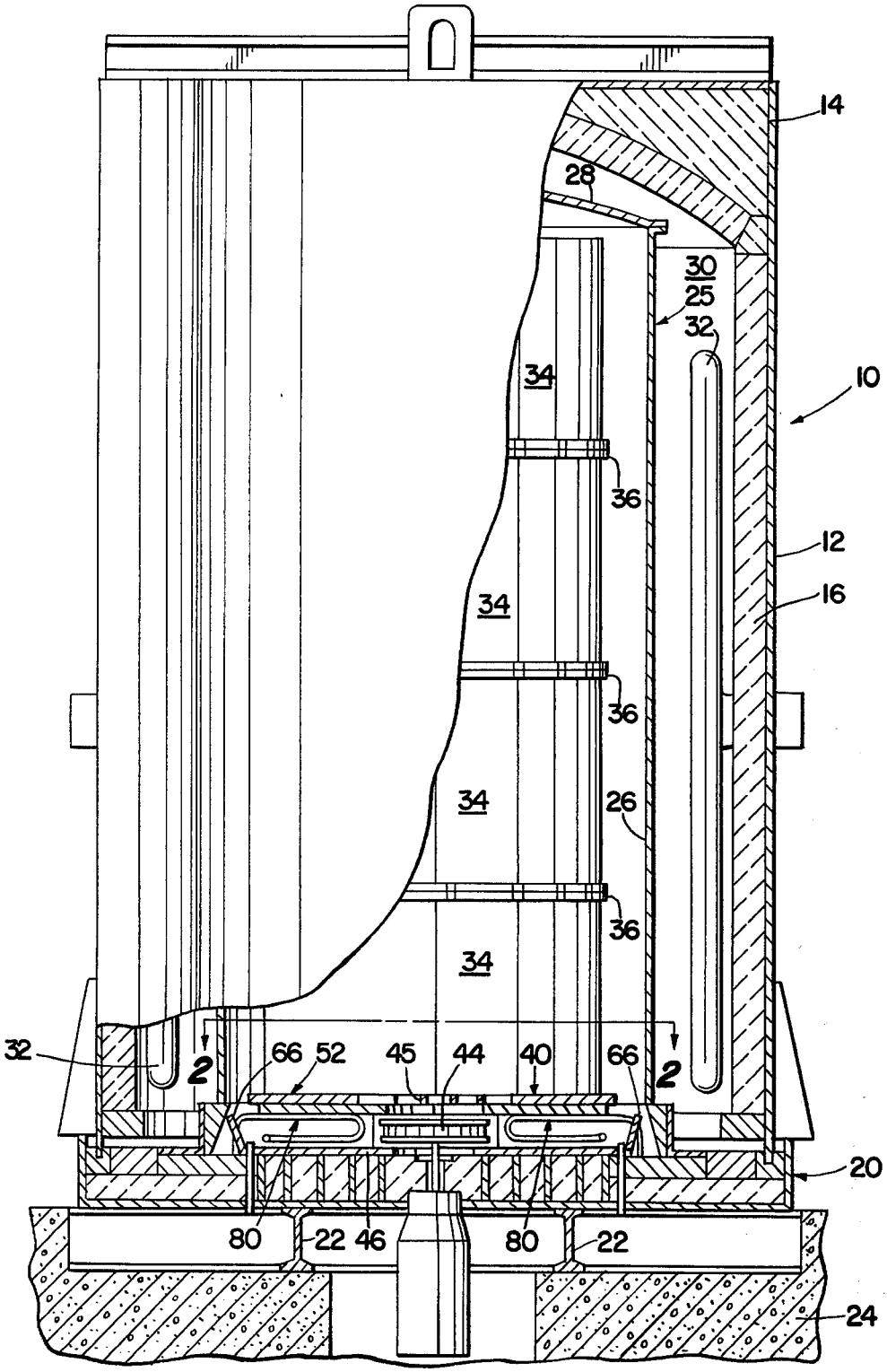
FIG. 1 is a vertical sectional view of a furnace incorporating a diffuser assembly of the present invention.

The present invention relates to diffuser assemblies for use in annealing furnaces. It is particularly suited for use as the diffuser assembly in an annealing furnace adapted for the heat treatment of a plurality of steel coils, such as those furnaces described in the present inventor's U.S. Pat. Nos. 3,586,302, 3,716,223, and 3,802,834, which include an inner cover. However, the skilled artisan will appreciate that the diffuser of the present invention could equally well be employed in other furnace structures with or without an inner cover, wherein the advantages of the present invention can also be realized. Accordingly, while the following description of preferred embodiments is made with reference to a furnace of the aforesaid character, this is meant to be illustrative only and not limitative.

Turning to the figures of drawing, in all of which like structure is identified by like reference numerals, a hood or bell-type annealing furnace, designated generally as 10, is shown to be comprised of an outer cylindrical wall 12 having a top closure wall 14. A suitable refractory lining 16 is provided for thermal insulation of the furnace 10. The furnace rests upon a base, designated generally as 20. In turn, the base 20 is supported by suitable means, such as I-beams 22, above a floor 24 or other foundation structure.

An inner cover is preferably disposed radially inward of the cylindrical side walls 12 and top closure 14. This inner cover, designated generally as 25, is comprised of a cylindrical side wall 26 and a top cover wall 28. The inner cover 25 is sealed on the base structure 20 by a ceramic seal 29, although other types of seals, such as granular seals, can be used under certain circumstances. A chamber 30 is formed intermediate the walls comprising the exterior of furnace 10 and the inner cover 25. Disposed within this chamber 30 are a plurality of heating means 32.

The charge to be heat treated is placed within the inner cover 25 of the furnace 10. In the embodiment shown in FIG. 1, this charge is comprised of a stack of sheet metal coils 34, four such coils being shown. The coils in the stack are separated from one another by coil separators or convector plates 36, such as those disclosed in certain of the aforementioned U.S. patents of the present inventor. The stack of coils rests upon the diffuser of the present invention, designated generally as 40, which is described in detail below.

The diffuser 40 is of a generally annular shape, and includes a central opening 42 coincident in location with the eyes or central openings in each of the coils 34. A fan 44, such as that disclosed and claimed in U.S. Pat. No. 3,669,563, is disposed within this central opening 42 for circulation of the heat-treating gas within the inner cover 25. A fan guard 45 is preferably placed in the opening 42 and over the fan 44 for protection thereof.

For a fuller description of the structure of furnace 10 and its operation, reference is made to the aforementioned U.S. patents, and particularly U.S. Pat. Nos. 3,586,302 and 3,802,834. Briefly summarizing these disclosures, the furnace 10 is assembled as shown in FIG. 1 with a charge such as the coils 34 disposed in a stack within the inner cover 25. The heating means 32 heat the chamber 30 and cylindrical wall 26 of inner cover 25, which heat is thence radiated to the interior of the inner cover. Heat-treating gas is circulated within the inner cover 25 by fan 44. The flow of gas is generally radially outward from the central opening 42, through the diffuser 40 and upwardly within the inner cover 25. The circulating gas is caused to wash across the heated side wall 26 whereby the gas itself is heated. Flow paths are provided radially inward through the convector or coil separator plates 36 to the eye or opening within each of the coils 34 in the stack being heat treated. Heated gas also passes upwardly within the inner cover 25 to the top cover member 28, to the eye area of the uppermost coil 34. Flow is then downwardly through the eyes back to the diffuser 40 under the influence of the fan 44.

Heating of the coils 34 is achieved by conduction across the metallic members comprising a load surface of diffuser 40 and each of the convector plates 36. Heating is also achieved by convection of the circulating gas around the coils 34 and throughout the wraps thereof.

The heating portion of the annealing cycle is very efficient when heat transfer plates (whether diffuser plates or convector plates) according to the present inventor's aforenoted U.S. patents are used in the furnace. However, once the proper temperature for the annealing treatment has been reached, the cool-down cycle is only as fast as heat can be dissipated from the inner cover. Cooling to a low enough temperature for removal of the charge from the furnace can require quite a number of hours. The principal advantage of the present invention is the ability to enhance the speed and efficiency of the cool-down portion of the cycle; whereby production efficiency is materially increased. These advantages are provided by the diffuser assembly 40, shown in detail in FIGS. 2–10.

The diffuser assembly 40 is comprised of a base plate 46, a diffuser member designated generally as 48, a cooling assembly designated generally as 50, and a load plate designated generally as 52.

Base plate 46 is advantageously an annular disc formed from a steel plate having an inner and an outer periphery. The diffuser member 48 is supported upon base plate 46.

Figure 3:
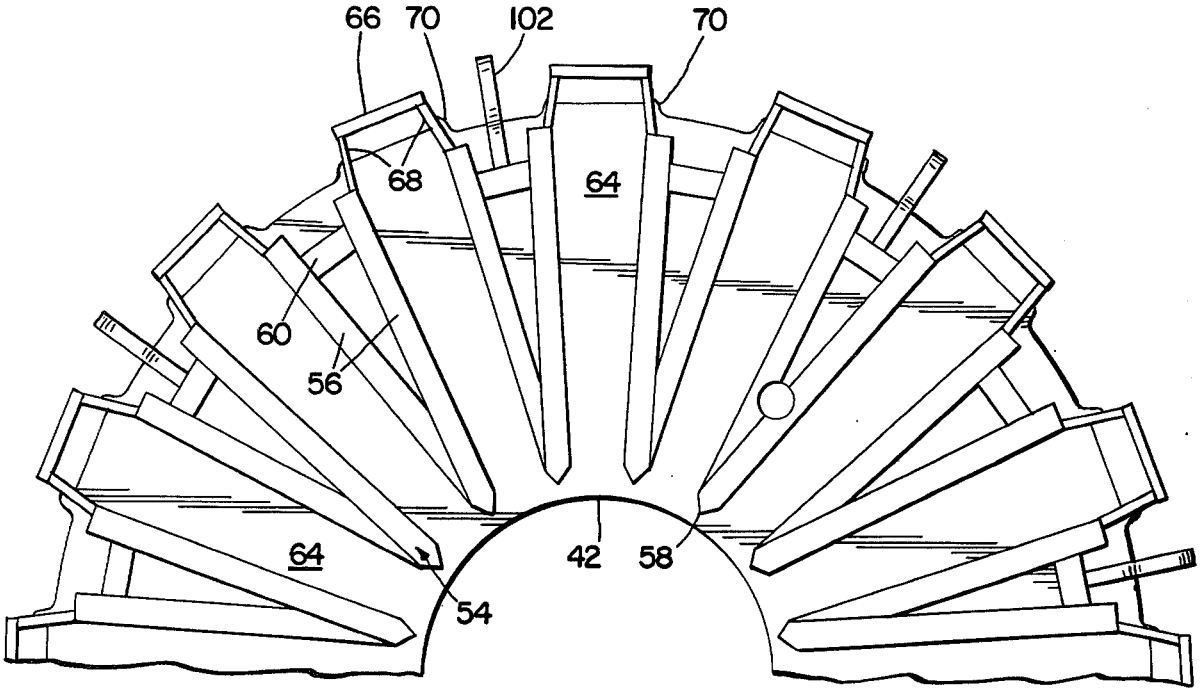
FIG. 3 is a fragmentary top plan view of the diffuser member of the diffuser assembly in accordance with the present invention.
Figure 7:
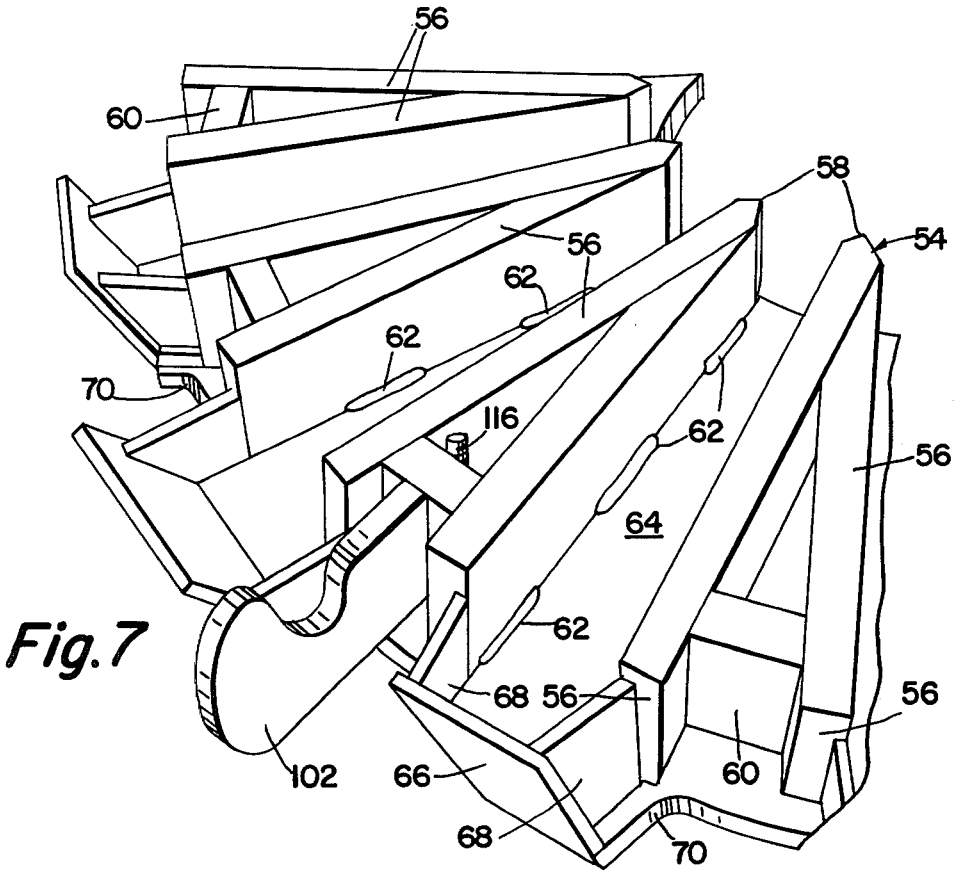
FIG. 7 is a fragmentary perspective view of the diffuser member shown in FIG. 3.

Diffuser member 48, best viewed in FIGS. 3 and 7, includes a plurality of flow dividers 54. The flow dividers 54 are spaced substantially equiangularly around the base plate 46, and extend generally from the inner to the outer periphery thereof. Each flow divider 54 is comprised of vertical radial walls 56 which, as best viewed in FIG. 3, are preferably individual metal plates welded or otherwise joined together in the overall shape of a "V". The walls 56, in addition to defining the shape of flow dividers 54, also provide support means for the load plate 52.

The apex of juncture of the "V" for each flow divider 54 points inwardly toward the central opening 42, which is the direction from which gas flows due to fan 44. It is also preferred that the apex of the "V" be somewhat pointed, such as is shown at 58, to reduce turbulence of flowing gas. In other words, it is advantageous to minimize the profile of any structural element transverse to the flow of circulating gas.

In the embodiment shown in the figures of drawing, the flow dividers 54 also include vertical circumferential walls 60 disposed between radial walls 56 comprising each of the dividers. These circumferential walls 60 provide added support for the load resting upon the diffuser 40. Accordingly, each flow divider is generally in the shape of an "A" in this preferred embodiment. Each of the vertical walls constituting the flow dividers, whether "V" or "A"-shaped, is secured to the base plate 46 by discontinuous weld beads 62, best viewed in FIG. 7.

A plurality of radial gas flow passages 64 are formed by, and in between, the flow dividers 54. These passages are bounded on either side by a vertical radial wall 56, and on the bottom by base plate 46. Because of the shape of the flow dividers, the radial passages 64 diverge outwardly along the flow path. That is, the passages become progressively wider from the inner to the outer periphery of the diffuser 40.

A flow deflector plate 66 is positioned at the discharge end of each of the radial passages 64. The deflector plate 66 is angled outwardly and upwardly, as best viewed in FIG. 7, to direct the circulating gas toward the cylindrical side wall 26 during the annealing process. Each deflector, shown to be a substantially rectilinear plate, is secured to the diffuser member 48 by a pair of fixture or mounting plates 68 extending from the vertical walls 56, the plates being, e.g., welded to opposite side edges of the deflector. The base plate 46 is preferably shaped to provide a plurality of ears 70, extending outwardly from the edge of the base plate coincident with each passage 64. The bottom edge of each deflector 66 is welded or otherwise secured on an ear 70.

The purpose of the fixture plates 68 and ears 70 is to extend the deflector plates 66 somewhat outwardly from the diffuser member 48 as compared with prior art diffusers. This better accommodates the placement of the cooling assembly 50 (described below) within the diffuser, and also aids in supporting the assembly. Accordingly, the skilled artisan will appreciate that there are many other ways in which the deflector plates 66 might be secured to the diffuser in addition to that shown in the figures of drawing.

Figure 4:
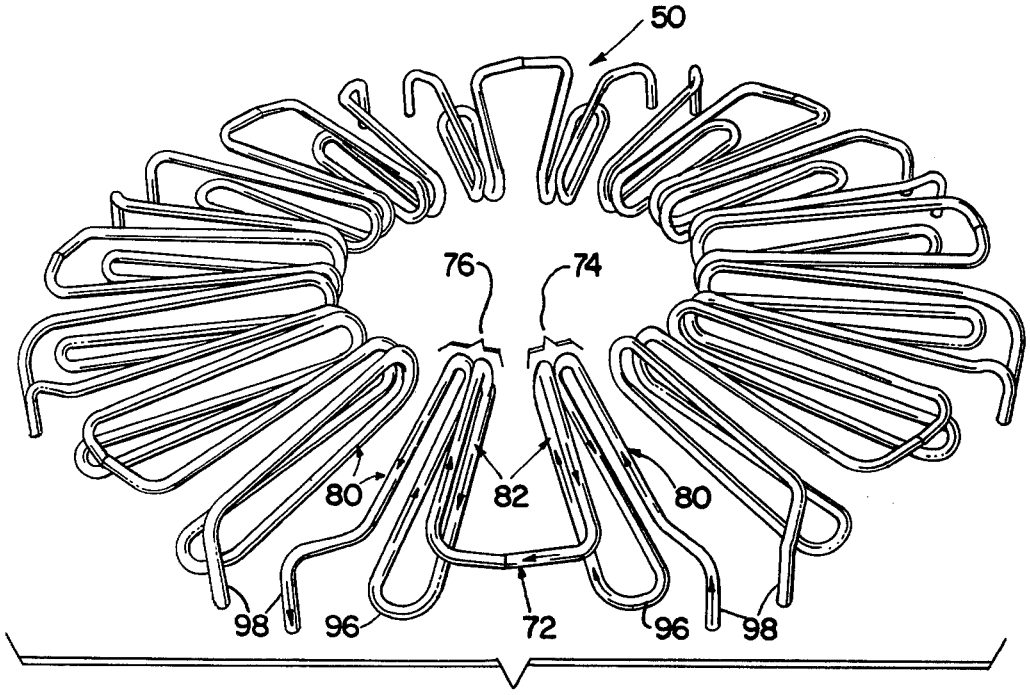
FIG. 4 is a perspective view, showing the cooling members for use in a diffuser assembly in accordance with the present invention.
Figure 10:
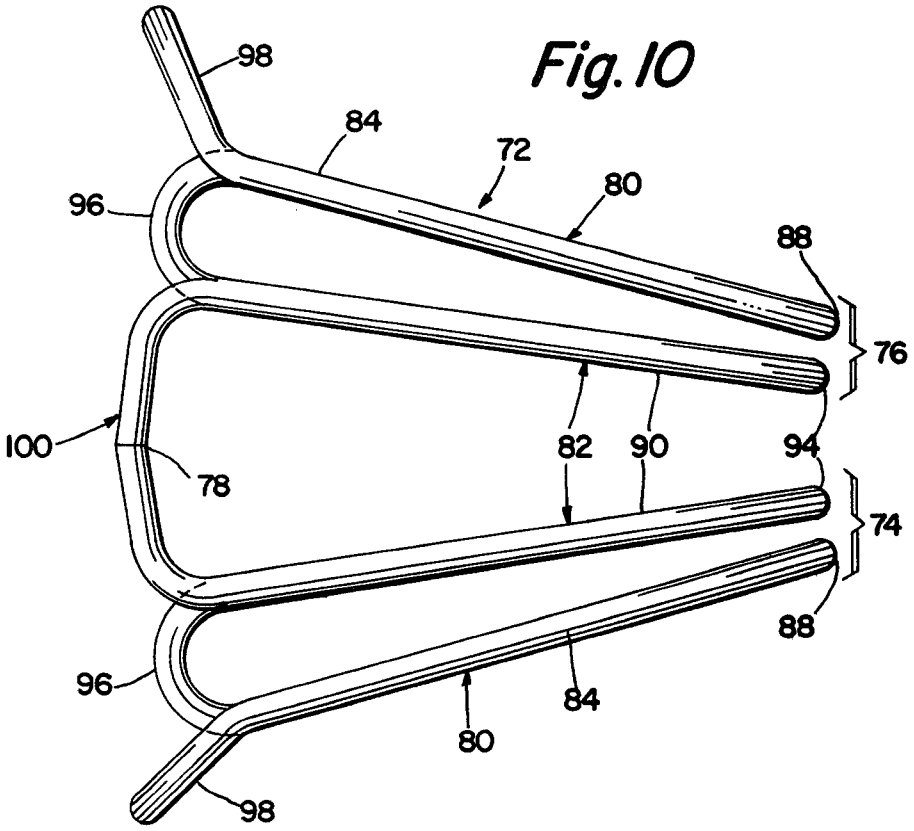

The cooling assembly 50, best viewed in FIG. 4, is preferably (but not necessarily) comprised of a plurality of individual cooling members 72. One of these members is shown in detail in FIG. 10. The cooling members are tubular, and are preferably fabricated from alloy steel tubing. Each individual cooling member 72 is advantageously made from two segments, a right-hand segment 74 and a left-hand segment 76, as shown in FIG. 10. Fabrication in this manner is somewhat easier since each segment can be formed individually and the two welded together at 78. However, the entire member 72 could be fabricated from a single continuous length of tube, rather than forming the two mirror-image individual segments.

Each of the segments 74 and 76 is comprised of a pair of radial cooling fluid legs 80 and 82. In the preferred embodiment shown in the figures of drawing, each of the radial legs 80 and 82 is formed in the shape of a "U", best shown in FIGS. 8 and 9. Accordingly, the legs 80 are comprised of an upper run 84, a lower run 86, and a connecting run 88 joining the two. In exactly the same way, radial leg 82 is comprised of an upper run 90, a lower run 92, and a connecting run 94 joining the two. As shown, curved run 96 joins adjacent radial legs 80 and 82 into the form shown in the figures of drawing, whereby the two legs are connected for continuous flow of cooling fluid.

The "U" of each of legs 80 and 82 extends horizontally within flow passages 64, in the sense that the open end of the "U" is toward the discharge end of the passages. It can also be seen that each "U" defines a substantially vertical plane. It will be appreciated by the skilled artisan, however, that these geometrical relationships between the elements of the cooling members are not rigid. For example, the "vertical" plane noted above may be, in actuality, somewhat skew without losing the advantages provided by in-line cooling.

Figure 2:
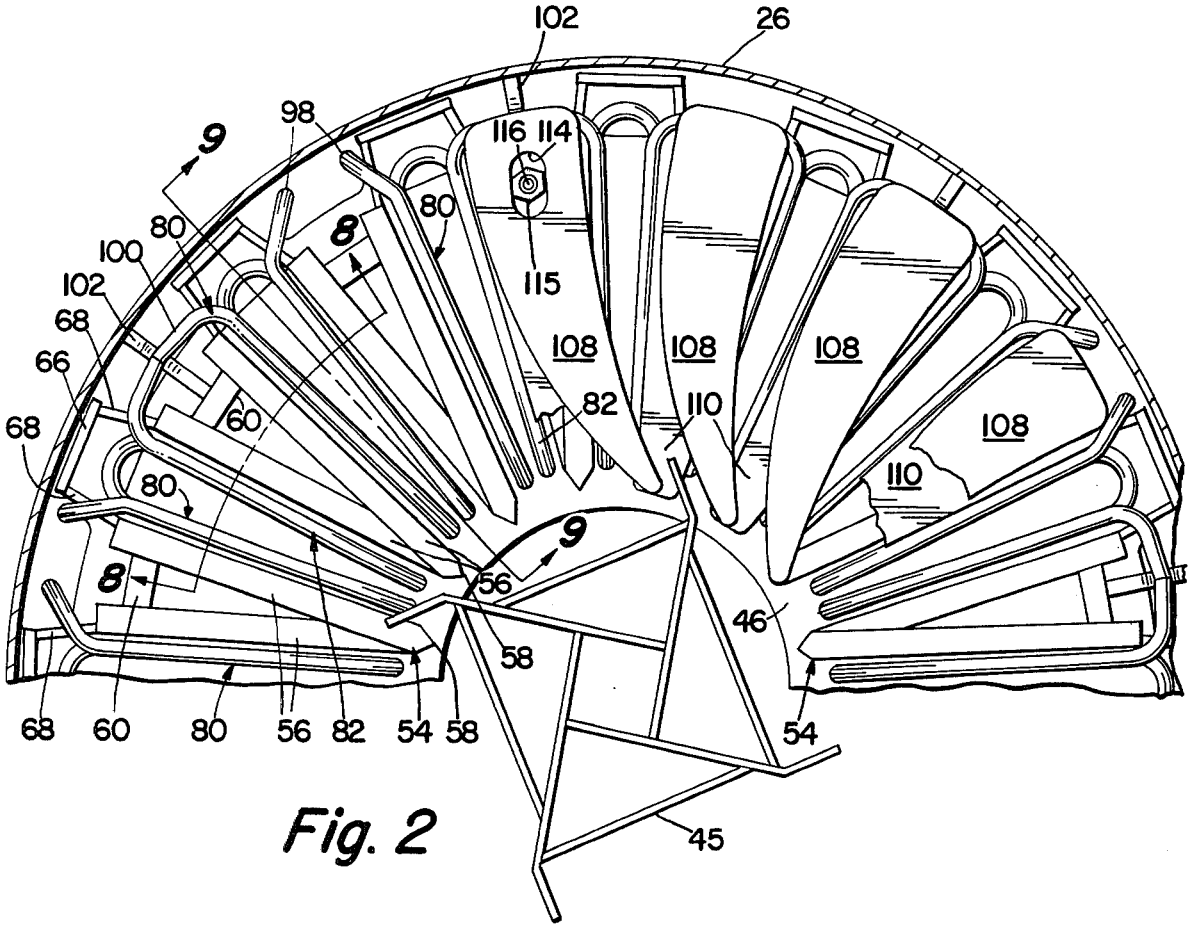
FIG. 2 is a fragmentary, top plan view of a diffuser assembly in accordance with the present invention.
Figure 8:
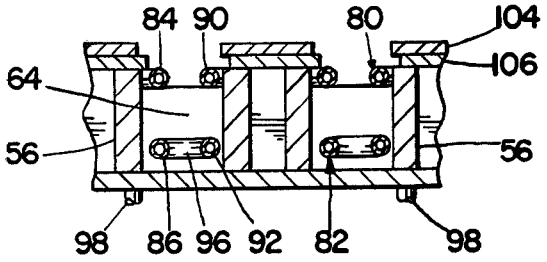
FIG. 8 is a fragmentary, developed, circumferential sectional view taken substantially along the line 8—8 of FIG. 2.

As can be seen from FIGS. 2, 8 and 10, the vertical planes through each radial leg are substantially parallel to, and lie longitudinally adjacent, the vertical walls 56. And, the length of each radial leg is about the same, or only slightly shorter than, the length of each radial passage 64. Thus, each radial cooling leg of the cooling assembly extends substantially in the direction of gas flow along the entire length of the gas flow passage, and diverges outwardly with the outwardly diverging walls defining these passages.

In the structure shown in FIG. 10, the cooling member 72 includes inlet/outlet legs 98, extending from the opposed radial legs 80, for directing the flow of cooling fluid throughout the member 72. For ease of description, the leg 98 of right-hand segment 74 will be considered the inlet side leg and that of the left-hand segment 76 the outlet side leg. Fluid will enter the inlet, pass through the outer radial leg 80 of segment 74 through the curved leg 96 and into the inner radial leg 82, across the yoke 100 connecting the right-hand and left-hand segments, through inner radial leg 82 of left-hand segment 76, through the curved leg 96 of that segment to the outer radial leg 80, and thence to the outlet side leg 98. This can be considered the same as connecting the outlet of right-hand segment 74 to the inlet of left-hand segment 76 at the location of weld 78, this connection corresponding to yoke 100.

Each of the individual cooling members 72 is adapted for placement in two adjacent radial passages 64, as best viewed in FIGS. 2 and 8. This will normally provide sufficient flow of cooling fluid throughout the cooling assembly to promote adequate cooling of the gas flowing through the radial passages. Of course, the overall dimensions of the diffuser will dictate in large measure the amount of cooling fluid which must be circulated. Guided by the principles of the present invention, those skilled in the art can easily adapt the specific structure of the cooling assembly 50 for various furnace sizes and cooling requirements. Along these lines, depending on the size of the furnace, etc., only a single radial cooling fluid leg might be required within a single gas flow passage (i.e., one "U" per passage).

The individual cooling members 72 are placed within the diffuser member 48 in a free-standing fashion. The bottom legs 86 and 92 are spaced from the base plate 46 and the radial legs 80 and 82 lie in vertical planes adjacent the vertical walls 56. The yoke 100 is supported by fixture plates 68 across its pan from one radial passage 54 to the next adjacent passage 64. The fixture plates 68 also support the inlet/outlet side legs 98. Added support for the yoke portion of each cooling member may be provided by an inner cover guide 102, best viewed in FIGS. 2 and 7. A number of these guides 102 are positioned around the outer periphery of the diffuser member 48. The principal purpose for these guides 102 is to locate and properly position the inner cover 25 with respect to the diffuser 40. However, they also may be adapted for added support of the cooling members 72.

The inlet/outlet side legs 98 pass beyond the base plate 46, rather than through this member as in certain prior art cooling assemblies. The present design permits free expansion and contraction of the components comprising the diffuser without adversely affecting the cooling structure. This is a very important consideration since any leaking of the cooling fluid, typically water, within the inner cover will cause unwanted and undesirable oxidation of the material being annealed. The tubes 98 preferably are routed through the base structure 20 of the furnace 10 to a manifold where all inlet side legs are joined together and all outlet legs are joined together in a known manner. Water or other suitable cooling fluid may then be circulated via the inlet manifold, through the cooling members as described above, and back through the outlet manifold where the cooling fluid, which has experienced some temperature rise, may be cooled before recirculation.

The structure of the cooling assembly 50 is not only efficient for its intended purpose of cooling the circulating gas within the furnace, it also minimizes disruption of the gas during both the heating and cooling cycles. This is attributable, in part, to the overall radial (i.e., in-line) design of the legs 80 and 82 within each of the passages 64. Because the legs run in approximately the same direction as gas flow, turbulence is minimized. Also, the effective surface area of the cooling members over which the gas flows is maximized to improve the efficiency of cooling.

Figure 5:
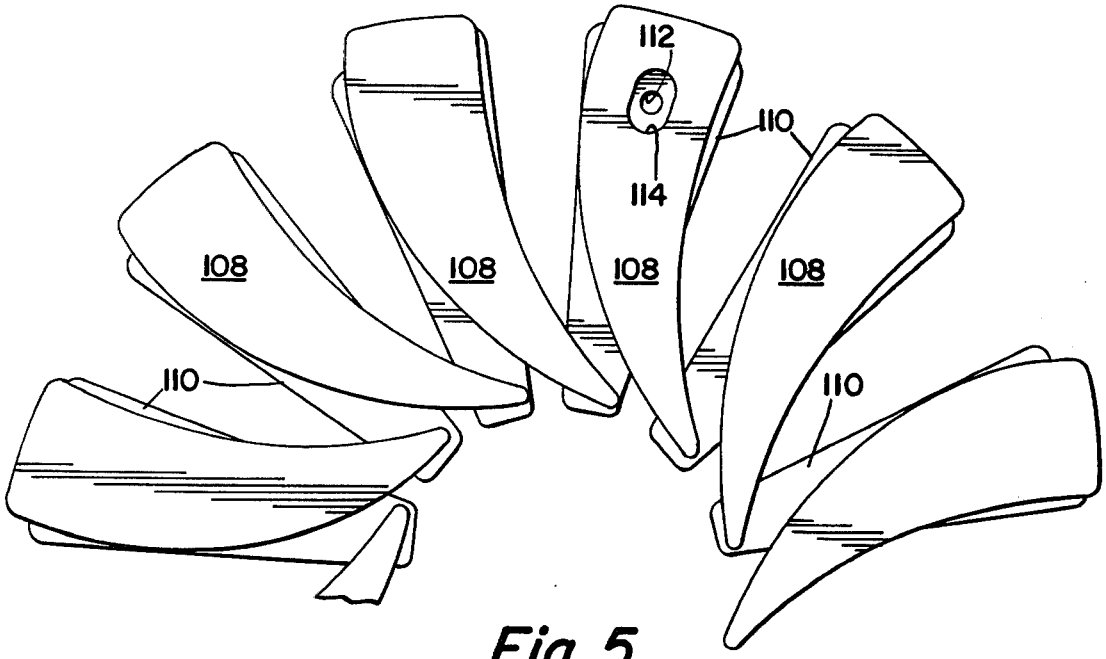
FIG. 5 is a fragmentary top plan view of one embodiment of a load plate for use in a diffuser assembly in accordance with the present invention.
Figure 9:
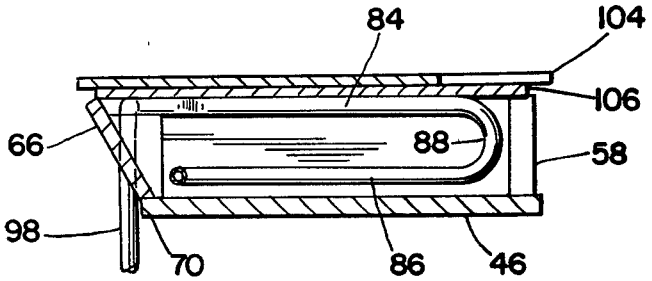
FIG. 9 is a radial sectional view taken substantially along the line 9—9 of FIG. 2; and, FIG. 10 is a top plan view of one of the cooling members shown in FIG. 4.

Once the cooling assembly has been placed within the diffuser member 48, a load plate 52 is secured to the diffuser member. A preferred load plate is shown in FIG. 5, which is similar to the plates disclosed and claimed in certain of the present inventor's aforenoted U.S. patents. This load plate is comprised of two contiguous layers of flat metal bars 104 and 106, as seen in FIG. 9. The bars in the upper layer 104, which are designated as 108, are of a curved shaped whereas the bars in the lower layer 106, designated as 110, are wedge shaped. The wedge-shaped bars 110 are radially positioned to the true radius of the diffuser; and the curved bars 108 in the upper layer have their end portions curved in a counterclockwise direction. This arrangement of plates improves the flow of the treating gas in the annealing process.

The load plate 52 shown in FIG. 5 is constructed in such a fashion that the upper curved bars 108 are joined with two wedge-shaped bars 110 in the lower layer. That is, the outer peripherial portion of a given curved bar is attached to a first bar 110, and the tip portion of the same bar 108 is joined to the tip of the adjacent wedge-shaped bar 110. The load plate 52 in FIG. 6 (where structure corresponding to that in FIG. 5 is indicated with primed numerals) is substantially identical with that shown in FIG. 5, save for the fact that the curved bars 108 are joined to three wedge-shaped bars 110 in the lower layer. Otherwise, the structures are comparable, in that the bars in the upper layer join one or more radial bars in the lower layer.

Regardless of the absolute orientation of the bars comprising upper and lower layers 104 and 106, respectively, the individual bars constituting the load plate are welded together to form a unitized piece. As shown in the figures of drawing, the load plate follows the overall geometry of the diffuser, in the sense that it has a segmented circular configuration defining inner and outer peripheries. By virtue of this design a number of vertical passages are formed in each load plate through which some gas may pass. It is preferred that the vertical passages lie radially beyond the tips of the cooling legs (i.e., beyond connecting runs 88 and 94) so that any gas passing through the vertical passages will be effectively cooled before rising through the charge in the furnace.

Figure 6:
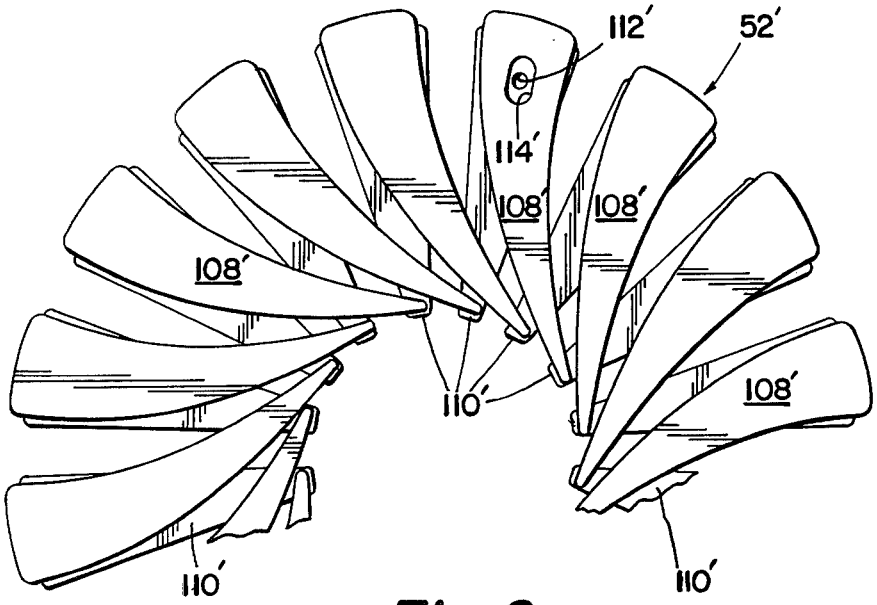
FIG. 6 is a fragmentary top plan view, similar to FIG. 5, of an alternate embodiment of a load plate for use in a diffuser assembly in accordance with the present invention.

It is desirable that the load plate 52 be removable from the diffuser member 48 to provide access to the cooling assembly 50. Therefore, it is preferred to provide hold-down means at spaced locations about the diffuser member 48. For example, three studs could be located equiangularly around the diffuser 48, projecting upwardly from or near the vertical walls 56 or 60. The load plate 52 will then be provided with counterbored holes or apertures 112, as shown in FIGS. 5 and 6, for receiving the studs. It is also preferable to somewhat elongate the countersunk portion of hole 112 to form a slot 114 within which a nut 115 may be received and tightened on the study members, such as is shown at 116. The slot 114 will allow limited relative movement between the load plate 52 and the supporting diffuser 48 to account for expansion and contraction of these parts during the heating and cooling cycles.

Operation of the diffuser of the present invention is very efficient. During the heating cycle, the fan 44 causes the heat-treating gas to circulate radially outward through the passages 64. When the gas encounters deflector plates 66, it is diverted upwardly and into contact with the heated side wall 26 of the inner cover 25, thereby heating the gas. The heated gas passes radially inward through appropriate channels in the convector plates 36 to the eye of the strip coil 34. Heated gas is also caused to pass between wraps in the coil by virture of passages, similar to the vertical passages described above, in these convector plates. The gas then passes downwardly through the eyes of the coils 34 and back to the fan; whereupon it is continuously recirculated throughout the inner cover. Heat is imparted to the coils in two ways. The heated gas heats the metal coils by convection. Also the heated gas heats the metallic components of the diffuser 40 and convector plates 36 and these plates, in turn, heat the metal coils 34 by conduction.

Once the heating portion of the annealing cycle has been completed, the furnace is removed. While the gas remains in circulation within the inner cover 25 by means of the fan 44, a cooling fluid such as water is introduced to the inlet side leg of each of the individual cooling members 72. The cooling fluid circulates throughout the members and reduces the temperature of the circulating gas, whereby the temperature of the charge (e.g., stack of coils 34) is reduced by the gas. Likewise, the heat transfer or convector plates will be cooled by the gas, and in turn, aid in reducing the temperature of the coils. Minimum obstruction to free passage of the circulating gas is encountered due to the design of the cooling assemblies. Nonetheless, maximum efficiency of cooling is realized. The components constituting the diffuser 40 may expand and contract throughout the annealing cycle without adversely affecting one another or the efficiency of heating and cooling. Also, the risk of failure at the inlet or outlet legs of the cooling assembly due to expansion and contraction is minimized as noted above. Accordingly, the diffuser of the present invention provides numerous substantial advantages to those desiring increased production output in annealing furnaces.

While the invention has now been described with reference to certain preferred embodiments, the skilled artisan will recognize that various modifications, changes, substitutions, and omissions may be made without departing from the spirit thereof, and the scope of the claims.

What is claimed is:

1. A diffuser, adapted for transmitting thermal energy by conduction across metallic members and convection of a heat-treating gas in an annealing furnace, comprising:

(a) a diffuser member having a generally annular shape defined by inner and outer peripheries, said diffuser member comprising:
  (i) a plurality of vertical radial walls for supporting a load plate;
  (ii) a plurality of radial gas flow passages, each being bounded on opposite sides by one of said radial walls, for directing gas along a substantially radial path;

(b) a cooling subassembly disposed in each of said radial passages, said subassembly comprising at least one radial cooling fluid leg extending substantially the length of each radial passage and having an upper and lower run, each of substantial length through the radial passage having a longitudinal axis extending in the direction of gas flow.

2. The diffuser of claim 1, wherein each of said subassemblies comprises a pair of radial cooling fluid legs, each of said legs being generally in the shape of a vertically oriented "U" extending in a horizontal direction, said legs being joined for continuous flow of cooling fluid.

3. The diffuser of claim 2, wherein the subassemblies are connected in pairs by joining the outlet of a subassembly in a given passage to the inlet of the subassembly in the next adjacent passage.

4. The diffuser of claim 3, wherein the subassemblies in two adjacent passages have a common inlet and a common outlet, all inlets and all outlets for the subassemblies being routed to respective inlet and outlet manifolds.

5. A diffuser, adapted for transmitting thermal energy by conduction across metallic members and by convection of a heat-treating gas in an annealing furnace, comprising:

(a) a base for supporting a diffuser member;

(b) a diffuser member having a generally annular shape defined by inner and outer peripheries, said diffuser member comprising:
  (i) a plurality of vertical radial walls for supporting a load plate;
  (ii) a plurality of radial gas flow passages, each being bounded on opposite sides by one of said radial walls, for directing gas along a substantially radial path;

(c) an in-line cooling assembly disposed within each of said radial passages, comprising:
  (i) a cooling fluid inlet side leg;
  (ii) at least two radial cooling fluid legs, disposed within a given one of said radial passages, each leg extending substantially the length of each said radial passage and having longitudinal axes extending substantially in the direction of the gas flow throughout said radial passage; and,
  (iii) a cooling fluid outlet side leg.

6. The diffuser of claim 1, wherein said radial passages taper outwardly toward said outer periphery, said legs diverging outwardly with the outwardly diverging radial walls and adjacent thereto throughout their length.

7. The diffuser of claim 5, further comprising a plurality of deflector plates disposed at the outer periphery of said diffuser member and outwardly from said diffuser member, and proximate the discharge ends of said radial passages.

8. The diffuser of claim 5, further comprising a load plate secured to said diffuser member.

9. The diffuser of claims 8, or 7, wherein said deflector plates are outwardly and upwardly angled plates secured to said diffuser at the discharge ends of said radial passages by fixture plates which extend beyond the adjacent vertical radial walls bounding said passages.

10. A diffuser, adapted for transmitting thermal energy by conduction across metallic members and by convection of a heat-treating gas in an annealing furnace, comprising:

(a) a base for supporting a diffuser member;

(b) a diffuser member having a generally annular shape defined by inner and outer peripheries, said diffuser member comprising:
  (i) a plurality of vertical radial walls for supporting a load plate;
  (ii) a plurality of radial gas flow passages, each being bounded on opposite sides by one of said radial walls, for directing gas along a substantially radial path;
  (iii) a plurality of deflector plates disposed at the outer periphery of said diffuser member, proximate the discharge ends of said radial passages;

(c) an in-line cooling assembly disposed within each of said radial passages, comprising:
  (i) a cooling fluid inlet side leg;
  (ii) at least two radial cooling fluid legs, disposed within a given one of said radial passages, each leg extending substantially the length of each said radial passage and having longitudinal axes extending substantially in the direction of the gas flow throughout said radial passage; and,
  (iii) a cooling fluid outlet side leg passing beyond the base.

11. The diffuser of claims 10 or 8, further comprising a load plate removably secured to said vertical walls.

12. The diffuser of claims 5 or 10, wherein said cooling assembly further comprises a circumferential yoke leg joining the outlet side leg of the radial cooling fluid leg in one passage to the inlet side leg of the radial cooling fluid leg in the next adjacent radial passage.

13. The diffuser of claims 5 or 10, wherein said cooling assembly further comprises a circumferential yoke leg joining the outlet side leg of the radial cooling fluid leg in one passage to the inlet side leg of the radial cooling fluid leg in the next adjacent radial passage, and wherein each of the said radial cooling fluid legs is comprised of a pair of "U"-shaped tubes, joined for continuous flow and comprises an upper and lower run.

14. The diffuser of claims 5 or 10 wherein said cooling assembly further comprises a circumferential yoke leg joining the outlet side leg of the radial cooling fluid leg in one passage to the inlet side leg of the radial cooling fluid leg in the next adjacent radial passage, and wherein each of the said radial cooling fluid legs is comprised of a pair of "U"-shaped tubes, joined for continuous flow and comprises an upper and lower run, and wherein the cooling assemblies are joined in pairs between adjacent radial passages, where the outlet side leg of one of said "U"-shaped tubes in a first passage is connected with the inlet side leg of one of said "U"-shaped tubes in the second passage by a circumferential yoke at said outer periphery.

15. The diffuser of claim 14, wherein all of said inlet side legs are joined to a cooling fluid inlet manifold, and all of said outlet side legs are joined to a cooling fluid outlet manifold.

16. The diffuser of claims 13, 14, or 15, wherein said "U"-shaped legs are vertically oriented and horizontally extending "U"-shaped legs.

17. The diffuser of claim 16, wherein each of said "U"-shaped legs defines a substantially vertical plane, said vertical planes being outwardly divergent toward said outer periphery.

18. The diffuser of claim 16, further comprising a plurality of vertical circumferential walls joining legs of said "V"-shaped flow dividers to yield a plurality of "A"-shaped flow dividers.

19. The diffuser of claim 10, wherein the cooling assemblies are joined in pairs between adjacent radial passages, where the outlet side leg of one of said "U"-shaped tubes in a first passage is connected with the inlet side leg of one of said "U"-shaped tubes in the second passage by a circumferential yoke at said outer periphery, and where said deflector plates are outwardly and upwardly angled plates secured to said diffuser at the discharge ends of said radial passages by fixture plates which extend beyond the adjacent vertical radial walls bounding said passages, and wherein said fixture plates comprise means for supporting said yoke.

* * * * *